US005138877A

United States Patent [19]

Desbrandes

[11] Patent Number: 5,138,877

[45] Date of Patent: Aug. 18, 1992

[54] METHOD AND APPARATUS FOR INTERSECTING A BLOWOUT WELL FROM A RELIEF WELL

[75] Inventor: Robert Desbrandes, Baton Rouge, La.

[73] Assignee: Louisiana State University and Agricultural and Mechanical College, Baton Rouge, La.

[21] Appl. No.: 542,575

[22] Filed: Jun. 25, 1990

[51] Int. Cl.[5] ..... E21B 49/10

[52] U.S. Cl. ..... 73/155; 73/151; 166/264

[58] Field of Search ..... 73/155, 152, 151; 166/250, 264

[56] References Cited

U.S. PATENT DOCUMENTS

| | | | |
|---|---|---|---|
| 2,313,176 | 3/1943 | Shelby | 73/155 |
| 2,747,042 | 5/1956 | Doll | 73/152 |
| 3,103,811 | 9/1963 | Ayres et al. | 73/152 |
| 3,577,781 | 5/1971 | Lebourg et al. | 73/152 |

*Primary Examiner*—Hezron E. Williams
*Assistant Examiner*—Michael Brock
*Attorney, Agent, or Firm*—William D. Kiesel; Robert C. Tucker

[57] ABSTRACT

A method and apparatus for determining the horizontal pressure gradient of an earth formation penetrated by a borehole. This is done by:

(a) establishing, through the wall of the borehole and isolated from fluids within the borehole, two direct fluid flow paths for communication with an adjacent formation to be tested, said direct fluid flow paths being on the same horizontal axis in the borehole but on opposing sides of the wall;

(b) drawing a fluid sample from the wall of the formation through each of said direct fluid flow paths, and (c) measuring and recording the difference in pressure between the two fluid flow paths.

15 Claims, 5 Drawing Sheets

METHOD AND APPARATUS FOR INTERSECTING A BLOWOUT WELL FROM A RELIEF WELL

FIELD OF THE INVENTION

The present invention relates to a method and apparatus for making horizontal pressure gradient measurements of an earth formation, which measurements are useful for determining the location of a blowout well from a relief well. The blowout well must be either open, or cased and perforated so that there is a pressure gradient in the formation from the relief well to the blowout well. The location is determined by use of a novel wireline downhole test tool capable of making differential pressure measurements.

BACKGROUND OF THE INVENTION

The control of a well may be lost accidentally during drilling or during production. When this happens, the well starts to blow wild, usually catching fire. Because economic and environmental loss occur at an increasing rate during the duration of a blowout, great effort is expended in trying to control the well. This usually involves drilling one or more relief wells. That is, another well is drilled at a safe distance away, which is intended to intersect or come within an effective distance of a lower section of the blowout well so that mud can be pumped into it to prevent flammable formation fluid from reaching the surface.

It will be appreciated that a relief well must be drilled with great directional accuracy in order for it to get within an effective distance of the blowout well. For example, the relief well may be drilled as far away as 1000 feet, or more, from the blowout well, whose borehole diameter is usually about one foot. Further, the blowout well was most likely directionally drilled, thus making intersection even more difficult.

Directional data may not be available on the blowout well, or even if it is, the trajectory of its borehole may not be known with sufficient accuracy to easily intersect it. Various systems have been developed to determine the location of a blowout well from the relief well. While most of them rely on in situ measurements, they usually require that the borehole of the blowout well contain a magnetic material, such as steel. This is because most in situ tools for locating blowout wells are designed to indicate the location of a magnetic material.

Consequently, there exists a need in the art for improved methods and apparatus for intersecting, or coming within an effective distance of a blowout well, in order to kill it. This is especially so when the borehole of the blowout well does not contain a mass of magnetic material, such as a drill stem.

SUMMARY OF THE INVENTION

In accordance with the present invention, there is provided a method for performing horizontal pressure gradient measurements in an earth formation penetrated by a well borehole, which method comprises:

(a) establishing, through the wall of the borehole and isolated from fluids within the borehole, two direct fluid flow paths for communication with an adjacent formation to be tested, said direct fluid flow paths being on the same horizontal axis in the borehole but on opposing sides of the wall;

(b) drawing a fluid sample from the wall of the formation through each of said direct fluid flow paths, and (c) measuring and recording the difference in pressure between the two fluid flow paths.

In a preferred embodiment of the present invention, the measurement is made with a wireline formation test tool containing two sample chambers, one in fluid communication with one of the direct fluid flow paths and the other in fluid communication with the other flow path, and which tool contains a differential pressure gauge for measuring the difference in pressure between the two direct fluid flow paths.

In another preferred embodiment of the present invention, there is provided a method for making measurements in a relief well to be used in determining the location of a blowout well from a relief well, which blowout well is either an open well or a cased and perforated well, which method comprises:

(a) positioning a wireline formation test tool down the relief well adjacent to the formation which is experiencing a pressure gradient due to the blowout well;

(b) engaging a pair of sealing means against the wall of the borehole, thereby isolating two areas of the borehole wall from fluids of the borehole, said pair of sealing means being comprised of two pads, located on the opposing sides of the tool from one another but on the same horizontal axis, wherein each pad contains a port in fluid communication with a fluid sampling chamber by a fluid passage;

(c) determining the orientation of the tool with respect to north;

(d) controlling the opening of said sampling chamber to allow fluid to enter said chamber by a first valve means;

(e) measuring and recording the formation pressure in each of said fluid passages;

(f) controlling the opening of a second valve means to allow the fluid passage of one port to be in direct fluid communication with one side of a differential pressure gauge and to allow the fluid passage of the other port to be in direct fluid communication with the other side of the pressure differential gauge;

(g) measuring and recording the pressure differential between the two ports; and (h) plotting the pressure differential measurement of step (g) above on a pressure gradient versus distance curve thereby determining the distance to the blowout well.

In another preferred embodiment, fluid is expelled from the tool, the sealing means released from the wall of the borehole, the tool rotated 90°, and another measurement taken by repeating steps (a) through (h). Thus, two measurements are made with respect to north and by vector analysis a resultant vector can be determined which will point toward the direction of the blowout well. Further, the distance to the blowout well is determined by plotting the differential pressure measurement of step (g) above on a pressure gradient versus curve generated by known and estimated values for parameters of the formation and the two wells.

There is also provided a wire-line formation test tool for performing horizontal pressure gradient measurements in a borehole traversing an earth formation, which tool comprises:

(a) an elongated body;

(b) an anchoring means to anchor the tool to the wall of the borehole;
(c) a sealing means comprised of a pair of extendible pads, each pad attached to the opposing side of the tool than the other, but on the same horizontal axis;
(d) a tool control means;
(e) two ports, each located in one of the pads;
(f) two sampling chambers each in fluid communication with a port by a connecting flow line;
(g) two absolute pressure gauges, one attached to each flow line;
(h) two first valve means for controlling the flow of fluid from said ports through said flow lines to said chambers;
(i) a differential pressure gauge;
(j) a second valve means for isolating said differential pressure gauge from one of the flow lines;
(k) a means to equalize pressure between said flow lines and the borehole;
(l) a means to empty the chambers;
(m) a means to rotate the tool in situ;
(n) a sensing means to indicate the orientation of the tool with respect to north; and (o) a sensing means to indicate the inclination of the tool in the borehole.

BRIEF DESCRIPTION OF THE FIGURES

FIG. 6 and 7 are calculated from parameters, which are known or can be easily determined, of the relief well and blowout well.

DETAILED DESCRIPTION OF THE INVENTION

In order to kill a blowout well, a relief well is drilled at a safe distance from the blowout well and deviated toward the blowout well for intersection, or for coming within an effective distance, at a given depth. The term, effective distance, as used herein, means that the relief well is drilled to within a distance within which the killing operation can be successfully achieved. Generally, this distance will be within about 15 feet of the blowout well. The killing operation is usually accomplished by flooding the formation with water, or drilling mud, when the relief well is within an effective distance from the blowout well, or pumping water or drilling mud directly into the blowout borehole when intersection is achieved. Most of time, the intersection does not occur on the first try and the blowout well is passed on one side or the other without knowing which. The relief well is then plugged and a side track drilled using the information obtained during the previous attempt, in the hope of getting within an effective distance from the blowout well on the next try. If this is not achieved again, the process is repeated until the relief well is finally intersected or is within an effective distance from the blowout well.

While conventional in situ methods for locating a blowout well from a relief well usually requires that the blowout well contain a magnetic metal at the desired depth of intersection, the present invention has no such requirement If a magnetic material is present in the blowout well, then the present invention can of course take advantage of it. Practice of the present invention primarily takes advantage of the fact that there is a pressure variation in the formation from the blowout well. This pressure variation extends to a certain distance from the well. That is, a pressure gradient can extend up to several hundred feet from the blowout well.

Figure 1:
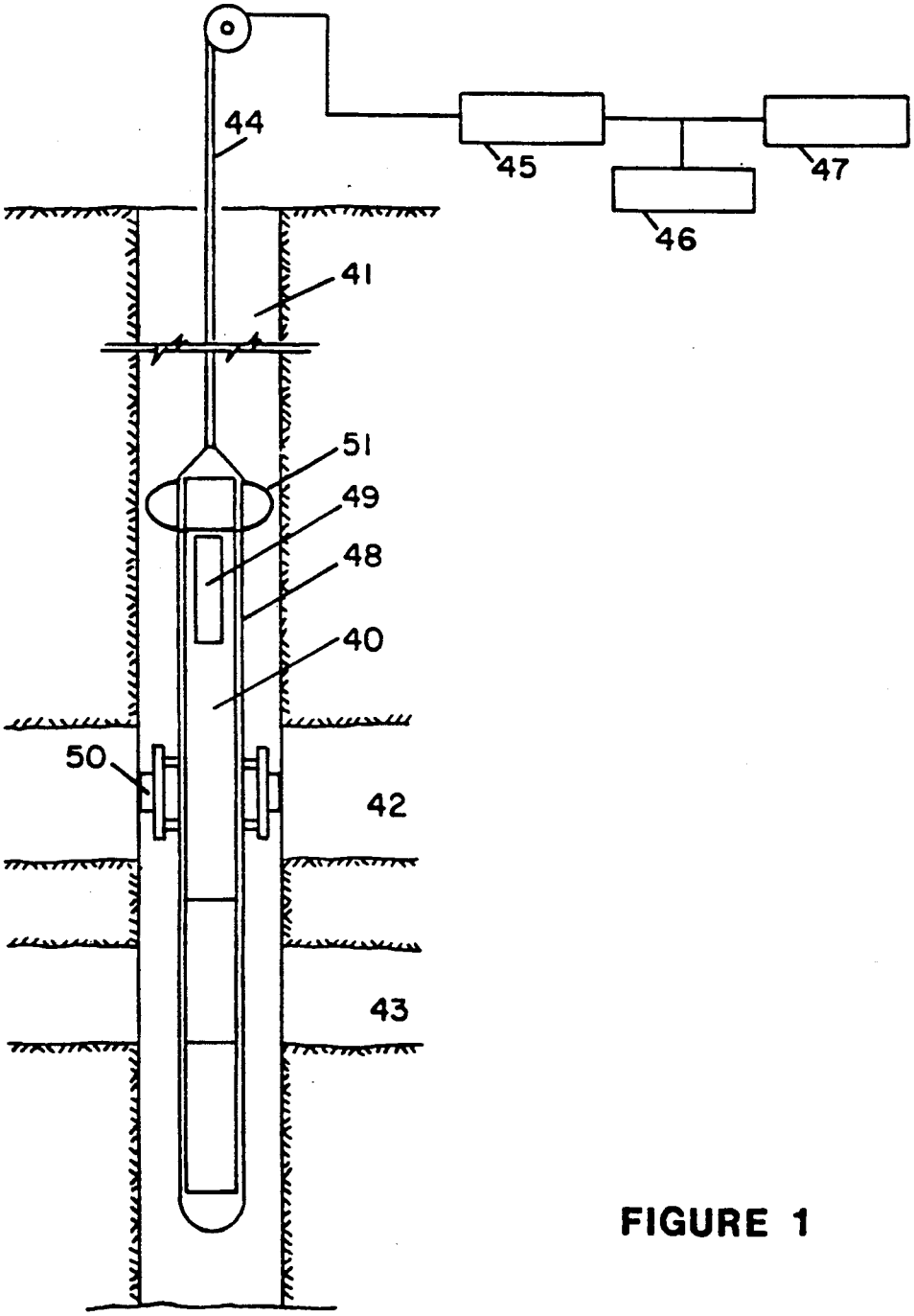
FIG. 1 hereof depicts a wire line tool of the present invention in a down hole position for making measurements for locating a blowout well.

Turning now to FIG. 1, a preferred embodiment of a new and improved measuring tool 40 incorporating the principles of the present invention is shown as it will appear during the course of a typical measuring operation in a bore hole 41 penetrating one or more earth formations as at 42 and 43. As illustrated, the tool 40 is suspended in the bore hole 41 from the lower end of a typical multi-conductor cable 44 that is spooled in the usual fashion on a suitable winch (not shown) at the surface and coupled to the surface portion of a tool control system 45 as well as typical recording and indicating apparatus 46 and a power supply 47. In its preferred embodiment, the tool 40 includes an elongated body 48 which encloses the down hole portion of the tool control system 49, such as hydraulic pressure pumps etc. to operate the tool, and carries the extendible anchoring and sealing means 50 on opposite sides of the body. An orienting and anchoring system 51, such as the J-slot system, is provided in the upper section of the tool.

Figure 2:
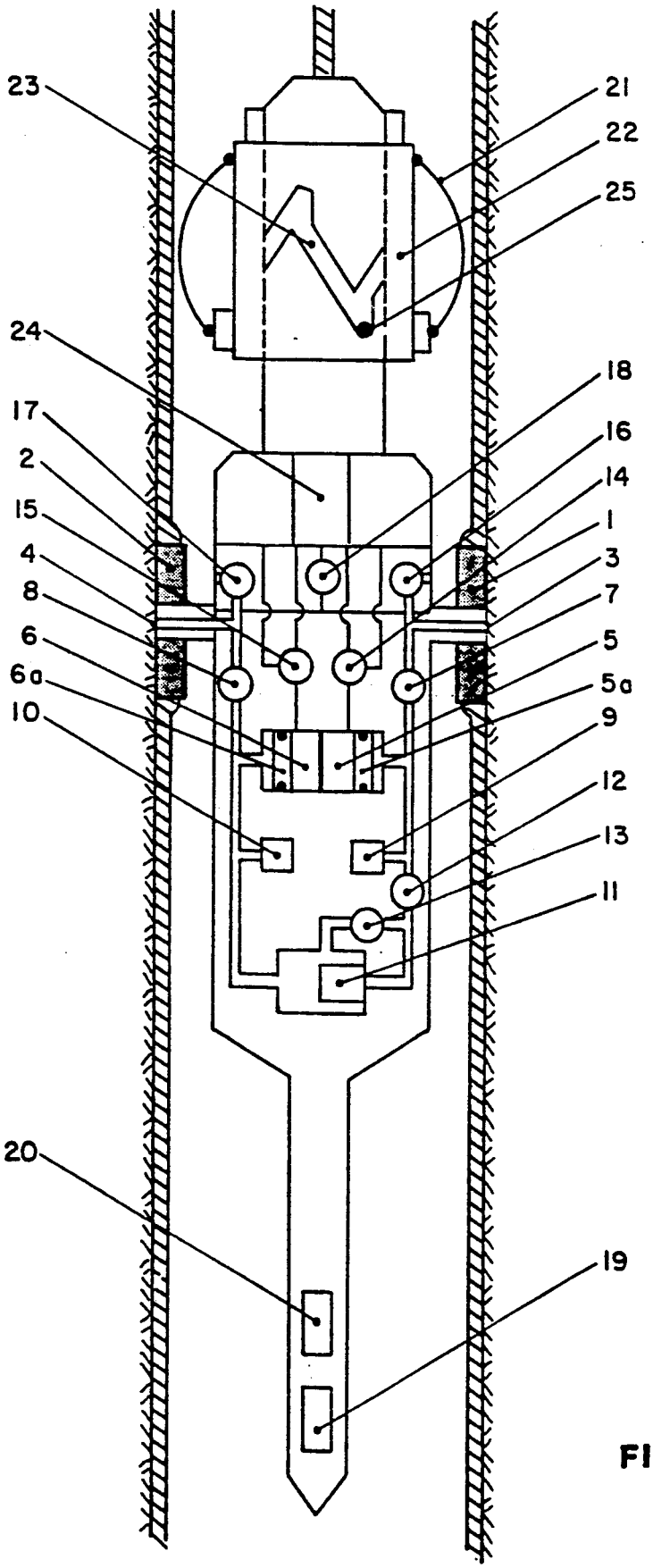
FIG. 2 hereof is a schematic representation of a wire line tool of the present invention.

FIG. 2 hereof is a schematic of a wireline test tool which incorporates the principles of the present invention for taking horizontal differential pressure measurements for determining the location of a blowout well. In operation, two opposite pads, or shoes, 1 and 2 are pushed out to sealingly contact the borehole wall in two diametrically opposite points at the same depth. That is, along the same horizontal axis on the wall of the borehole. The mud cake on the wall of the borehole provides a pressure seal between the pads and the wall of the borehole, thus isolating two surface areas of the wall from fluids in the borehole. Ports 3 and 4, located in each pad, are connected to two sampling chambers 5 and 6 which accommodate 1 to 100 cc of fluid, by means of flow lines, or passages. The size of the chambers will depend on the permeability of the formation. The tighter the formation the smaller the volume of the chambers so that the chambers can be filled fast enough to allow for a formation pressure determination in as short a period of time as possible. These chambers may be designed in any known way, for example, with pistons 5a and 6a to empty them between measurements. Valves 7 and 8 control the flow of fluid into and out of these chambers.

Two gauges 9 and 10 measure the pressure in each flow line. A sensitive differential pressure gauge 11 is first exposed on both sides to the pressure of port 4 with valve 13 being open and valve 12 closed. When gauges 9 and 10 are at substantially the same pressure, valve 13 is closed and valve 12 is opened to make an accurate differential pressure measurement between ports 3 and 4. If the pressures are substantially different while valve 13 is closed and valve 12 is open, damage can occur to the sensitive differential pressure gauge. Valve 13 is again opened and valve 12 closed so that the two ports will again be isolated. Valves 16 and 17 are then opened to equalize the pressure in the flow lines with the hydrostatic mud pressure in the borehole.

Valves 14 and 15 can then be opened thereby forcing hydraulic fluid into the chambers and moving the pistons to empty the tool of fluid. Valve 18 is used to release the pads from the wall of the borehole. It will be understood the pads can be first released from the wall of the borehole followed by emptying the tool of fluid. Hydraulic pump 24 supplies the hydraulic pressure for all functions. A "J" type orienting system 22 with centralizer springs or arms 21 which contact the borehole wall makes the tool rotate a fraction of a turn at each reciprocating motion up and down when the stud 25 travels in the "J" slot 23. Tool orienting systems, such a "J" slots, are well known in the art and further explanation herein is not needed. The "J" slot system is designed to cause the tool to rotate in situ a predetermined number of degrees with every unsetting and resetting of the tool in the borehole. For purposes of the present invention it is preferred that the tool rotate 90° each time. Sensors 19 are used to determine the orientation of the tool with respect to north. They can be of the magnetometer type or gyroscopic type. An inclination sensor 20 indicates if the relief well is slanted so the required corrections can be made.

A measurement is made as follows:

1) Apply the pads to the borehole wall;
2) Record the orientation of the tool with respect to north and the inclination of the borehole;
3) Open valves 7 and 8, with valves 12 and 13 being closed;
4) Measure pressure with gauges 9 and 10 as chambers 5 and 6 fill, and record pressures for each gauge;
5) Open valve 13 to let fluid from port 4 act on both sides of differential pressure guage 11;
6) When pressures are stable and substantially equal, close valve 13, open valve 12 and read the differential pressure between ports 3 and 4;
7) Close valve 12, open valve 13 to isolate the two ports;
8) Open valves 16 and 17 and retract pads using valve 18;
9) Using valves 14 and 15, empty chambers 5 and 6;
10) Close valves 7, 8, 16 and 17; and
11) Reciprocate tool by use of orientating mechanism 21, 22, 23, and 25 until next orientation is obtained and repeat above steps at least once, preferably at least two times, more preferably at least three times, and most preferably at least four times.

Determination with respect to north can be made with the use of magnetic sensors in the test tool. Three sensors, positioned at right angles to one another, supply the three components of the earth's magnetic field, thus enabling one to know the direction of magnetic north with respect to the tool. The inclination measurement can be done with three accelerometers. They supply the three components of the earth's gravitational field, or gravity. The corresponding vector is the vertical vector pointing to the center of the earth. Thus, by a simple vector analysis, inclination of the tool and orientation of the tool with respect to north can be calculated. Such calculations are well within the skill of those of the art.

Near the blowout well, the earth's magnetic field may be perturbed if there is a substantial amount of magnetic material in the borehole of the blowout well. In such cases, orientation with respect to north can be made by making an inertial measurement with gyroscopes. Three gyroscopes can be strapped to the tool which will give the rate of rotation of the earth during each test around three axis. These three components of the earth's rotation can be composed to determine the earth's rotation vector which is in the meridian plane and consequently defines true geographic north. Using the accelerometer data, one can derive the earth's gravity vector or vertical vector. A simple vector analysis can be used to calculate the orientation of the pads.

The differential pressure measured on two opposite sides of the relief well can be used to determine the slope (or derivative) of the curve. The value of the derivative indicates the distance from the blowout well if the tool is oriented radially from the blowout well. That is, if a radius is drawn from the center of the borehole of the blowout well through the pads of the test tool, then no additional measurements will be needed to locate the blowout well. But, this is normally not the case. Several measurements are normally required and can be made by rotating the tool to measure the gradient of pressure between the two pads of the tool, and determining the radial direction if the tool is given at least two arbitrary but known orientations.

Differential pressure measurements can be made along two perpendicular directions, oriented with respect to north. A resultant vector is then determined which points toward the blowout well. The amplitude of this vector is proportional to the derivative of the pressure versus distance from the blowout well to the relief well. Corrections must be made if the relief well is inclined. One correction corresponds to the inclination and the other corresponds to the hydrostatic pressure. Such corrections can easily be made by one having ordinary skill in the art and will not be elaborated on any further.

A distance calculation is made as follows by first preparing pressure versus distance and pressure gradient versus distance curves. The horizontal pressure measurements obtained by the practice of the present invention are then plotted on the pressure gradient versus distance curve to determine the distance to the blowout well. For example, flow in the vicinity of a borehole is generally considered as radial. Formulas have been established by petroleum engineers to compute the pressure in a reservoir if the permeability, porosity, fluid viscosity, formation temperature, Z factor, formation thickness, borehole diameter, boundary reservoir pressure and flowing well pressure are known. In a blowout well, flowing well pressure and flow rate can be estimated with various techniques.

A pressure versus distance curve is generated from known or estimated values of the wells by use of the formula:

$$P = P_w + \frac{Q\gamma \ln(d/R_h)}{7.08\ kh}$$

where;

P = pressure at distance d;

$P_w$ = downhole flowing pressure in the blowout well;

Q = flowrate of the blowout well;

$\gamma$ = viscosity of the fluid flowing out of the blowout well;

k = permeability of the formation;

h = thickness of the formation;

$R_h$ = blowout borehole radius; and d = distance from the blowout well.

A pressure gradient versus distance curve can then be calculated by use of the formula:

$$\frac{\Delta P}{\Delta d} = \frac{P_1 - P_2}{d_1 - d_2}$$

where;

$p_1$ = pressure at distance $d_1$;

$P_2$ = pressure at distance $d_2$;

$\Delta P$ = maximum pressure differential in the relief well if, $\Delta d$ = diameter of the relief well.

Figure 6:
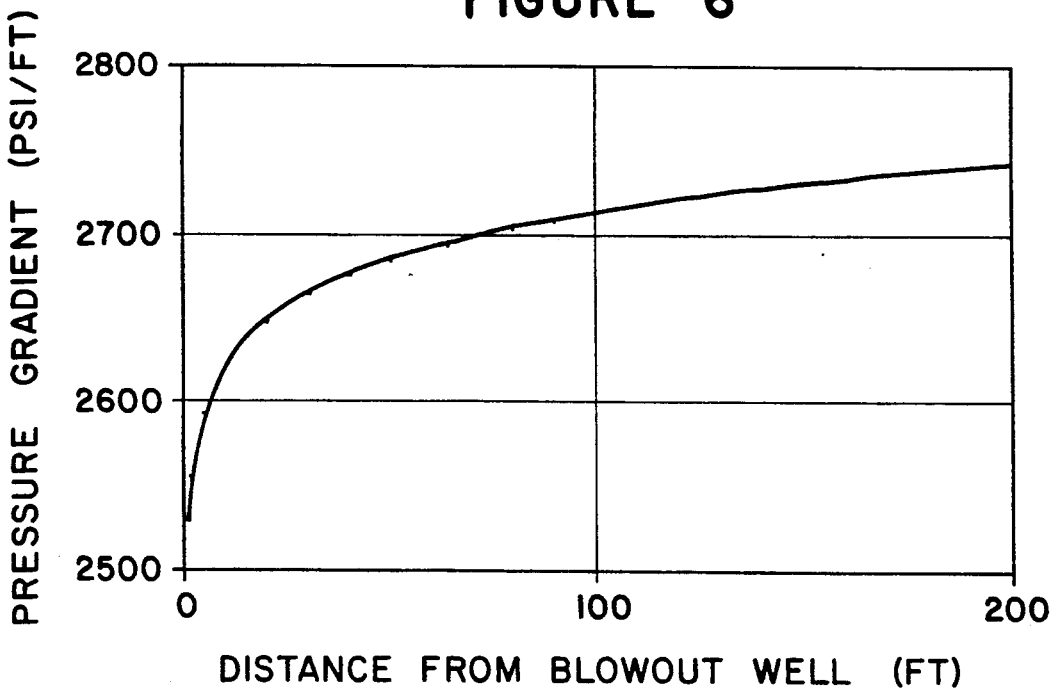
FIG. 6 hereof is a pressure versus distance curve which can be used in the practice of the present invention for locating the blowout well.
Figure 7:
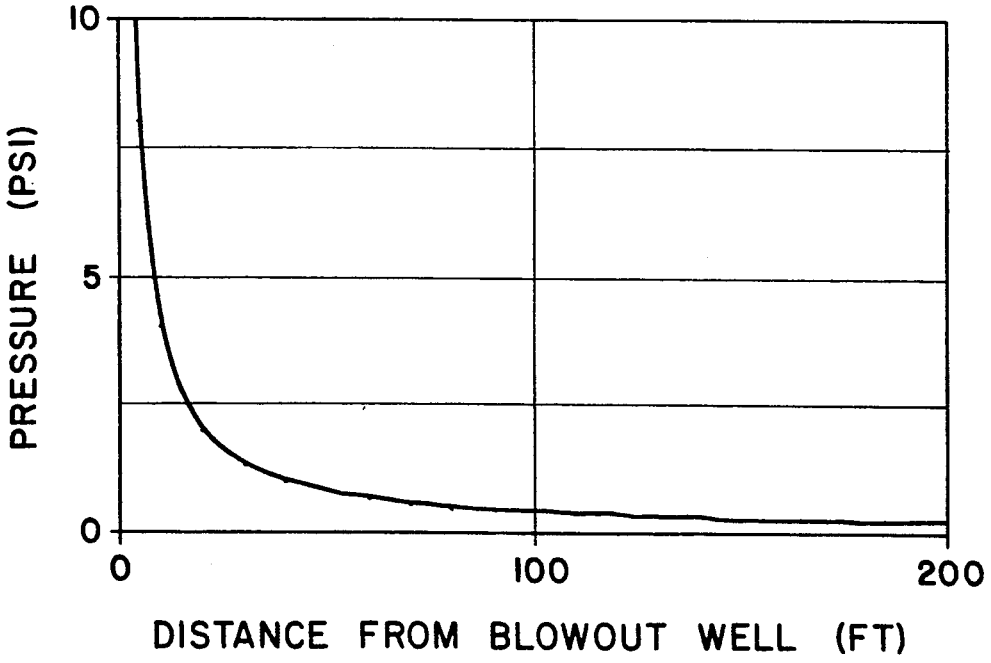
FIG. 7 hereof is a pressure gradient curve with is also used in the practice of the present invention for locating a blowout well. Curves for both

For example, FIGS. 6 and 7 hereof were prepared by use of computer simulated data for a relief well borehole having a one foot diameter, a formation pressure of 2804 psia, and a pressure in the formation at the blowout of 2500 psia. The data is as follows:

| Dist. to BOW in Feet | Psi Center RW | Psi at Far Side of RW | Psi at Near Side of RW | ΔP |
|---|---|---|---|---|
| 1 | 2527.73 | 2500.00 | 2543.94 | 43.94 |
| 2 | 2555.45 | 2543.94 | 2564.38 | 20.43 |
| 5 | 2592.10 | 2587.89 | 2595.38 | 8.03 |
| 10 | 2619.83 | 2617.78 | 2621.78 | 4.00 |
| 20 | 2647.56 | 2646.54 | 2648.54 | 2.00 |
| 30 | 2663.77 | 2663.10 | 2664.43 | 1.33 |
| 40 | 2675.28 | 2674.78 | 2675.78 | 1.00 |
| 50 | 2684.21 | 2683.80 | 2684.60 | 0.80 |
| 60 | 2691.50 | 2691.16 | 2691.83 | 0.67 |
| 70 | 2697.67 | 2697.38 | 2697.95 | 0.57 |
| 80 | 2703.01 | 2702.76 | 2703.26 | 0.50 |
| 90 | 2707.72 | 2707.50 | 2707.94 | 0.44 |
| 100 | 2711.93 | 2711.73 | 2712.13 | 0.40 |
| 200 | 2739.66 | 2739.56 | 2739.76 | 0.20 |
| 1000 | 2804.04 | 2804.02 | 2804.06 | 0.04 |

BOW = blowout well
RW = relief well

The pressure differential measurement obtained by use of the present invention are then plotted on the pressure gradient versus distance curve to determine the distance to the blowout well.

Figure 3:
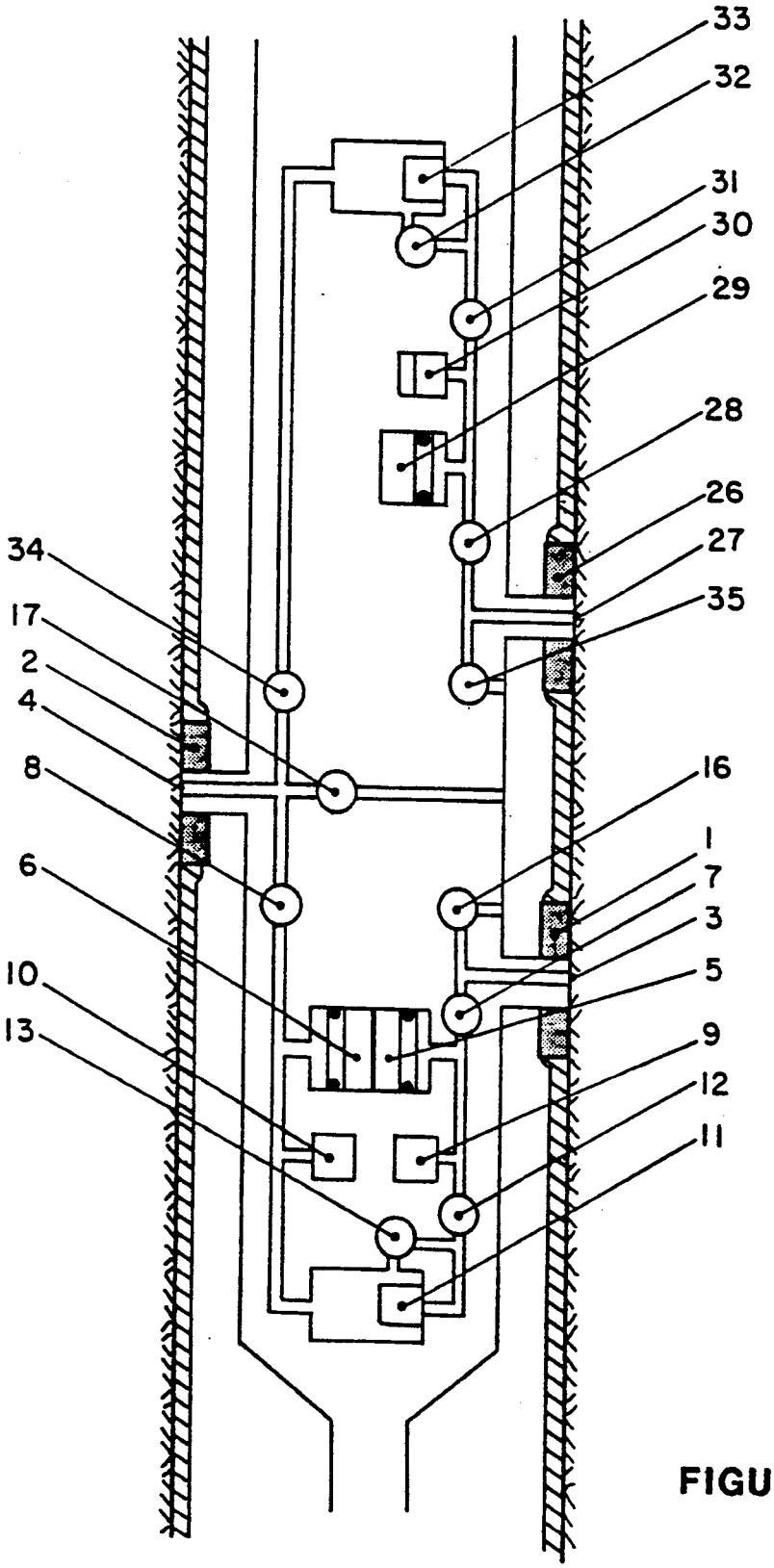
FIG. 3 hereof is a schematic representation of an alternative wire line tool of the present invention which shows a tool with three pads and which can be used for making horizontal and vertical pressure gradient measurements.
Figure 4:
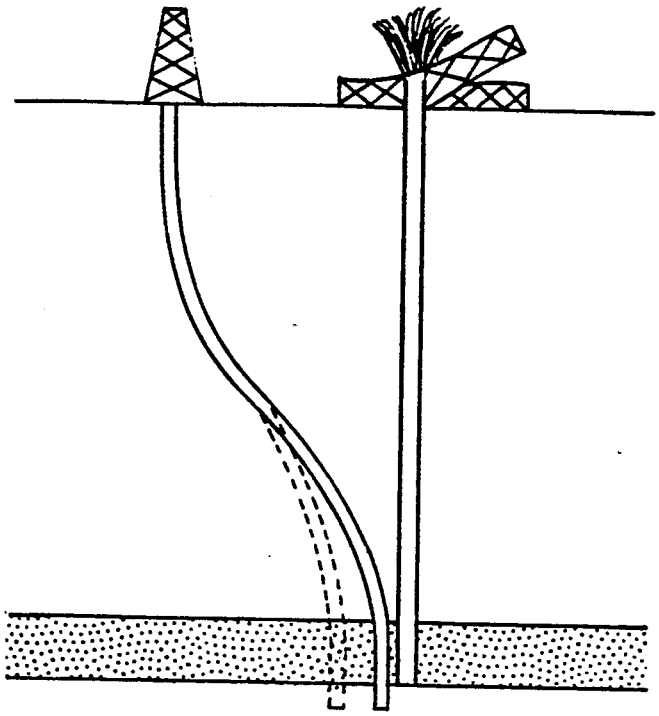
FIG. 4 hereof is a simplified representation of how a relief well might be drilled to intersect a blowout well.
Figure 5:
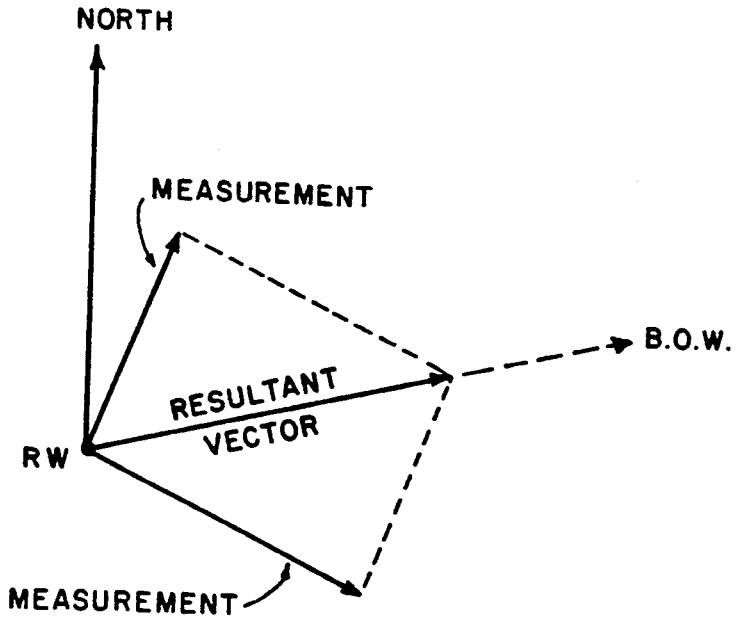
FIG. 5 hereof is a representation of a resultant vector determined by two measurements made at right angles to each other. The vector points toward the blowout well and its amplitude is related to the distance to the blowout well.

When the borehole is of a small dimension, the downhole apparatus of FIG. 2 cannot be used as previously described because the pistons or blocks 3 and 4 holding the shoes 1 and 2 would be in the way of one another. The invention is then implemented by using three pads. FIG. 3 hereof is a schematic of an alternative tool of the present invention which can be used in small diameter boreholes. It shows the pads as being offset in such a way that they can retract to a dimension compatible with the smaller borehole size. The lower part of the tool is similar to the tool of FIG. 2 hereof, and thus the common parts are similarly numbered. The upper part of the tool has a seal pad 26 with a port 27 in its center. The three pads are to be set at the same time, a small sample is drawn from each pad to make sure that a seal is obtained. After verifying that the three formation pressures are substantially the same, valves 13 and 32 are closed and valves 12 and 31 are opened in order to make the differential pressure measurements. The flow line valve 28 controls the flow into chamber 29. An absolute pressure gauge 30 monitors the filling of chamber 29. Valve 31 controls the connection of the flow line to the differential pressure gauge 33. Valve 32 is actuated to measure the differential pressure between port 27 of pad 26 and port 4 of pad 2 once valve 34 has been opened. This apparatus provides two differential pressure readings between pad 1 and 2 and between pad 26 and 2. Adding these differential pressure readings gives the horizontal differential pressure. Subtracting these differential pressure readings gives the vertical differential pressure. For example, it will allow one to determine the viscosity of the fluid which is used in the equation (1) for plotting the pressure versus distance curve.

While only two particular embodiments of the present invention and one mode of practicing it has been shown and described, it is apparent that changes and modification may be made without departing from the present invention is its broader aspects, therefore, the aim in the appended claims is to cover all such changes and modifications as fall within the true spirit and scope of the present invention.

What is claimed is:

1. A method for performing horizontal pressure gradient measurements in an earth formation penetrated by a well borehole, which method comprises:

(a) establishing, through the wall of the borehole and isolated from fluids within the borehole, two direct fluid flow paths for communication with an adjacent formation to be tested, said direct fluid flow paths being on the same horizontal axis in the borehole but on opposing sides of the wall;

(b) drawing a fluid sample from the wall of the formation through each of said direct fluid flow paths, and (c) measuring and recording the difference in pressure between the two fluid flow paths.

2. The method of claim 1 wherein the measurement is made with a wireline formation test tool containing two sample chambers, each in fluid communication with one of the direct fluid flow paths, and which tool contains a differential pressure gauge for measuring the difference in pressure between the two direct fluid flow paths.

3. The method of claim 1 wherein the pressure gradient is caused by a blowout well within the vicinity of the borehole in which the measurement is taking place.

4. The method of claim 3 wherein the blowout well is within 1000 feet of the borehole in which the measurement is taking place.

5. A method for making measurements in a relief well to be used for determining the location of a blowout well from a relief well, which blowout well is either an open well or a cased and perforated well, which method comprises:

(a) positioning a wireline formation test tool down the relief well adjacent to the formation which is experiencing a pressure gradient due to the blowout well;

(b) engaging a pair of sealing means against the wall of the borehole, thereby isolating two areas of the borehole wall from fluids of the borehole, said pair of sealing means being comprised of two pads, located on opposing sides of the tool from one another but on the same horizontal axis, wherein each pad contains a port in fluid communication with a fluid sampling chamber by a fluid passage;

(c) determining the orientation of the tool with respect to north;

(d) controlling the opening of said sampling chamber to allow fluid to enter said chamber by a first valve means;

(e) measuring and recording the formation pressure in each of said fluid passages;

(f) controlling the opening of a second valve means to allow the fluid passage of one port to be in direct fluid communication with one side of a differential pressure gauge and to allow the fluid passage of the other port to be in direct fluid communication with the other side of the pressure differential gauge; and (g) measuring and recording the pressure differential between the two ports.

6. The method of claim 5 including after step (g), the step of equalizing the pressure of the fluid in the test tool with the hydrostatic pressure of the mud in the borehole, expelling fluid from the test tool, rotating the tool a fraction of a turn, and conducting another measurement by repeating steps (a) through (g).

7. The method of claim 6 wherein: (i) the direction of the blowout well and the maximum value of $\Delta P$ are determined by vector analysis; (ii) a pressure versus distance curve and a pressure gradient versus distance curve are generated, the pressure versus distance curve being generated by use of the formula:

$$P = P_w + \frac{Q\gamma \ln(d/R_h)}{7.08\ kh}$$

where:

P=pressure at distance d;

$P_w$=downhole flowing pressure in the blowout well;

Q=flowrate of the blowout well;

$\gamma$=viscosity of the fluid flowing out of the blowout well;

k=permeability of the formation;

h=thickness of the formation;

$R_h$=blowout borehole radius; and d=distance from the blowout well; and the pressure gradient versus distance curve being generated by use of the formula:

$$\frac{\Delta P}{\Delta d} = \frac{P_1 - P_2}{d_1 - d_2}$$

where;

$p_1$=pressure at distance $d_1$;

$P_2$=pressure at distance $d_2$;

$\Delta P$=maximum pressure differential in the relief well if, $\Delta d$=diameter of the relief well; (iii) the distance to the blowout well is determined by plotting the pressure differential measurements between the two ports on the pressure gradient versus distance curve; (iv) the relief well is drilled to within an effective distance of the blowout well; and (v) the blowout well is killed by flooding it with an appropriate fluid.

8. A wire-line formation test tool for performing horizontal pressure gradient measurements in a borehole traversing an earth formation, which tool comprises:

(a) an elongated body;

(b) an anchoring means to anchor the tool to the wall of the borehole;

(c) a sealing means comprised of a pair of extendible pads, each pad attached to the opposing side of the tool than the other, but on the same horizontal axis;

(d) a tool control means;

(e) two ports, each located in one of the pads;

(f) two sampling chambers each in fluid communication with a port by a connecting flow line;

(g) two absolute pressure gauges, one attached to each flow line;

(h) two first valve means for controlling the flow of fluid from said ports through said flow lines to said chambers;

(i) a differential pressure gauge;

(j) a second valve means for isolating said differential pressure gauge from one of the flow lines;

(k) a means to equalize pressure between said flow lines and the borehole;

(l) a means to empty the chambers;

(m) a means to rotate the tool in situ;

(n) a sensing means to indicate the orientation of the tool with respect to north; and (o) a sensing means to indicate the inclination of the tool in the borehole.

9. The tool of claim 8 in which the control means includes a hydraulic pump, sump, and connecting lines to operate all of said valves and anchoring and sealing means.

10. The tool of claim 8 wherein each chamber contains a piston to draw and empty fluid from the chamber.

11. The tool of claim 8 wherein the chambers vary in size from about 1 to 100 cc.

12. The tool of claim 8 wherein said second valve means is comprised of a first valve on one side of said differential pressure gauge which can isolate one of said flow lines from said gauge from one of the chambers and a second valve on the other side of said differential pressure gauge which can isolate the other flow line from the other chamber.

13. The tool of claim 8 wherein said chambers have a seal means to contain a sample inside and allow retrieval of said sample to the surface.

14. The tool of claim 13 wherein the seal means are valves.

15. The tool of claim 8 wherein said means to equalize pressure is a third valve means positioned in said flow lines which allow from fluid to be expelled to the borehole through another set of ports.

* * * * *